United States Patent [19]

Keeler et al.

[11] 4,360,292

[45] Nov. 23, 1982

[54] GROUTED STRAND ANCHOR AND METHOD OF MAKING SAME

[76] Inventors: Andrew L. Keeler, 25-32 33d St., Astoria, N.Y. 11102; Ronald Marsico, 2500 6th St., East Meadow, N.Y. 11554

[21] Appl. No.: 153,956

[22] Filed: May 28, 1980

[51] Int. Cl.[3] ..... E02D 5/74

[52] U.S. Cl. ..... 405/244; 52/166; 405/260; 405/239

[58] Field of Search ..... 405/260, 261, 258, 262, 405/244, 239; 52/155-163, 166

[56] References Cited

U.S. PATENT DOCUMENTS

| | | | |
|---|---|---|---|
| 1,602,394 | 10/1926 | Dean . | |
| 3,060,694 | 10/1962 | Holmes | 405/239 |
| 3,296,688 | 1/1967 | Hervig | 29/272 |
| 3,316,797 | 5/1967 | Williams | 405/260 X |
| 3,412,511 | 11/1968 | Dietrich . | |
| 3,436,923 | 4/1969 | Lagerstrom | 405/260 |
| 3,641,772 | 2/1972 | Dietrich | 405/262 |
| 3,656,729 | 4/1972 | Borgert | 249/18 |
| 3,913,187 | 10/1975 | Okuda | 24/255 SL |
| 3,971,177 | 7/1976 | Endo | 405/260 X |
| 3,978,674 | 9/1976 | Herbst . | |
| 4,000,623 | 1/1977 | Meardi | 405/260 |
| 4,036,137 | 7/1977 | Dietrich | 52/166 X |
| 4,092,814 | 6/1978 | Kern . | |
| 4,124,983 | 11/1978 | Weatherby | 405/260 |
| 4,159,605 | 7/1979 | Ilokowicz | 52/687 |
| 4,231,683 | 11/1980 | Vanderline | 405/260 |
| 4,247,225 | 1/1981 | Chickini et al. | 405/260 |

FOREIGN PATENT DOCUMENTS

| | | | |
|---|---|---|---|
| 259462 | 1/1968 | Austria | 405/260 |

OTHER PUBLICATIONS

VSL Corp. Brochure "Pre-stressed Rock and Soil Anchors".

*Primary Examiner*—Dennis L. Taylor
*Attorney, Agent, or Firm*—Pennie & Edmonds

[57] ABSTRACT

A grouted strand anchor and method of making the same comprising a pre-drilled anchor hole, a strand having centering means thereon for centering the strand in the hole, and grout surrounding the strand and engaging the sides of the hole for transferring tension loads in the strand by shear forces in the grout to the sides of the hole.

9 Claims, 4 Drawing Figures

GROUTED STRAND ANCHOR AND METHOD OF MAKING SAME

FIELD OF THE INVENTION

The invention relates to a grouted strand anchor for transferring tension loads to the ground and to a method of making the same.

BACKGROUND ART

Various tension anchorage devices have been proposed which may be used, for example, to anchor supporting or guy lines for electric transmission towers. Some of these anchorage devices have utilized tension bars or tension wires embedded into drilled holes extending into the ground where the rods or wires are connected to large anchor blocks which are of greater diameter than the drilled holes. A problem with this type anchorage device is that it necessitates heavy, cumbersome drilling and digging equipment to drill and dig holes of sufficient size to provide the space for the enlarged anchorage blocks. Transmission towers are often erected in mountainous or hilly terrain and are guyed by supporting cables which may extend a considerable distance from the base of the towers with the result that the ends of the supporting cables are often anchored in relative hard-to-get-to areas. This requires that sufficient access routes or paths be made in order to transport the drilling and digging equipment to the area of the anchorage device. Such routes, particularly in hilly or mountainous regions, are expensive to make.

Other anchorage devices have utilized drilled holes which have extended a considerable distance into the ground depending upon the tension loads and soil conditions encountered. Where tension rods are utilized, such rods are of a length sufficient to contact the bottom of the drilled holes with the result that the rods are unwieldy to handle. If the rods are sectioned in shorter lengths, then they require relatively heavy coupling members to connect the rod sections together in order to withstand the tension loads.

In some instances pre-tensioned strand is placed in drilled holes after which grout is pumped into the holes. This requires tensioning equipment as well as an additional structure to hold the strand in tension while grout is injected into the hole. All this equipment must be brought to the anchorage area, which as explained above, may present a problem in hilly and mountainous terrain.

Anchorage devices also must be designed to withstand corrosion over a period of time. Devices have been proposed which involve pre-tensioning wires or rods positioned in tubes which are then filled with grout where the tube acts as protective covering for the wires or rods to prevent corrosion. The tube, including the grouted wires or rods, is then inserted into a pre-drilled hole after which additional grout is inserted between the tube and the sides of the pre-drilled hole. The insertion of the wires or rods into the tube usually is done at a workshop remote from the anchorage area thus making it difficult to transport the tube, grout, wire or rod assembly to the anchorage area.

A further difficulty arising from using rods as tension members, particularly in long pre-drilled holes, is that the hole must be drilled in a straight line to accommodate the straight rod. This is also difficult unless heavy rugged drilling equipment is utilized, which as explained above, may be difficult to position in rough terrain.

It is therefore an object of our invention to provide for an anchorage device which may be conveniently assembled at an anchorage site utilizing conventional drilling equipment without requiring use of any digging equipment to make large holes in the ground. It is a further object of the invention to provide for an anchorage device which will be projected against corrosion and which at the same time may be made from conventional materials readily available on the market.

It is a further object of our invention to provide for an anchorage device which will accommodate slight irregularities in the direction of a drilled hole in the ground while at the same time provide intimate contact between the member of the device adapted to withstand tension forces and grout which surrounds the tension member. The tension forces in the tension member are then transferred by shear forces in the grout to the sides of the drilled hole to hold the tension member in place.

GENERAL DESCRIPTION OF THE INVENTION

Broadly a grouted strand anchor according to our invention comprises a predetermined length of a bridge strand which is made up of a plurality of pre-stretched, pre-twisted galvanized wires. The strand is positioned and centered in a hole drilled to a predetermined depth and diameter in the ground. The strand includes a plurality of longitudinally spaced centering means thereon which engage and surround the strand and which are adapted to center the strand in the drilled hole. The strand is locked into the hole by grout which surrounds and intimately engages the strand and the centering means whereby tension loads in the strand are transferred by shear forces in the grout to the sides of the hole. A protective sheath in the form of a pipe may surround the upper portion of the strand and grout adjacent the ground level in order to minimize grout breakage and corrosion of the wires adjacent the ground level.

The strand is preferably positioned in the hole such that the bottom end of the strand is substantially adjacent the bottom of the hole and whereby a portion of the strand will extend above ground level.

The method of making the strand anchor comprises the steps of drilling an anchor hole in the ground to a predetermined depth and diameter which is determined by the soil conditions encountered and the tension loads to be imparted on the strand. A plurality of centering means are longitudinally spaced along the strand and the strand and centering means are then inserted into the hole until the bottom of the strand is substantially adjacent the bottom of the hole. Grout is then pumped into the anchor hole to a level substantially equal to ground level such that the grout will intimately contact the wires of the strand and centering means.

Preferably the grout is pumped into the hole through a grout hose which extends along the length of the strand. After the level of the grout has risen to substantially ground level, the hose is removed from the hole while at the same time continuing to pump grout through the hose.

A casing hole may be drilled at ground level to extend a short distance into the ground prior to drilling the anchor hole. The casing pipe is then inserted in the casing hole to form a casing so as to extend approximately one foot above ground level. The anchor hole is then drilled to the predetermined depth.

DESCRIPTION OF THE PREFERRED EMBODIMENT

Figure 1:
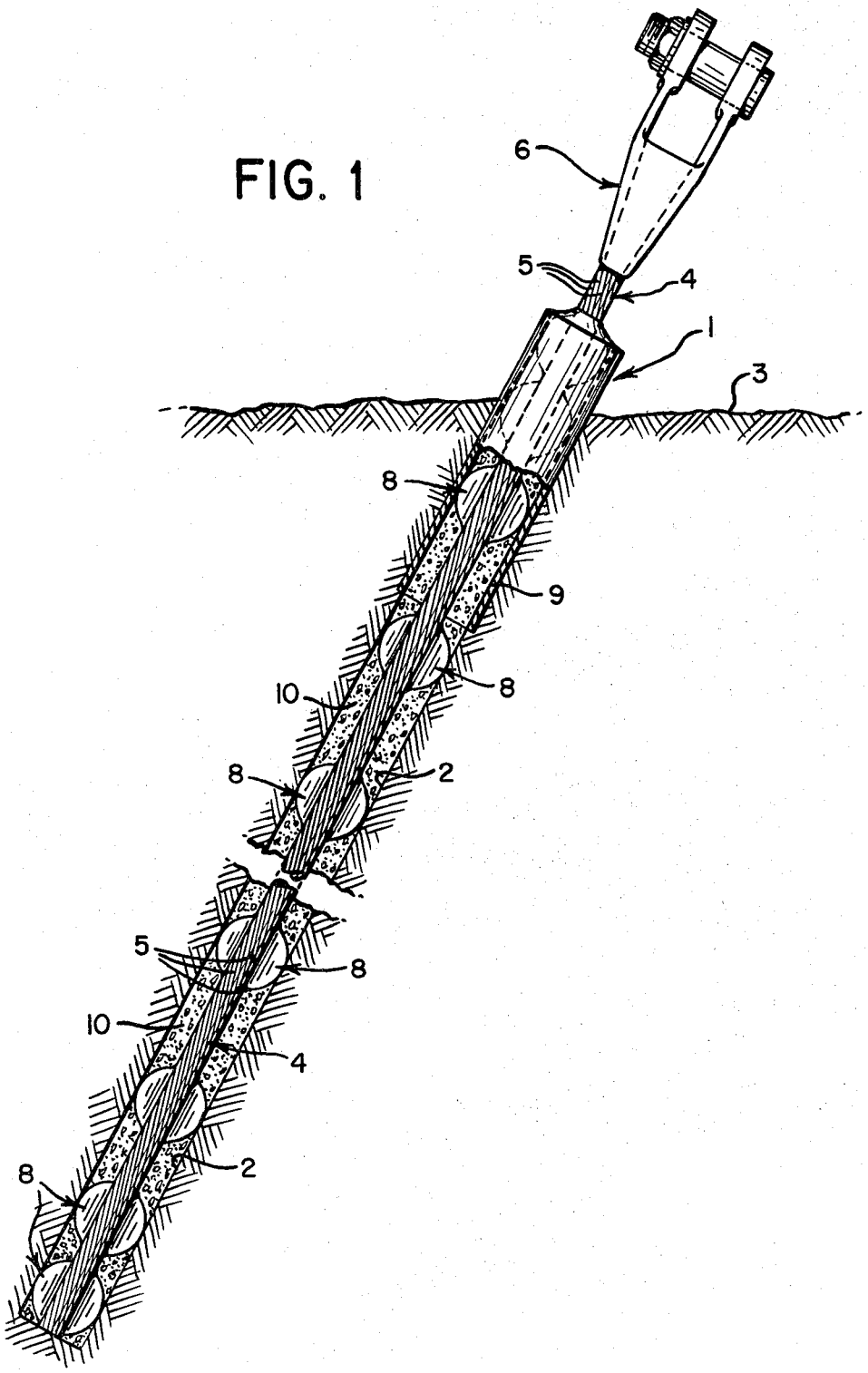
FIG. 1 is a sectional schematic view of a grouted strand anchor constructed according to the invention.

Referring to FIG. 1 there is illustrated a grouted strand anchor 1 constructed according to the invention inserted into a pre-drilled anchor hole 2 of predetermined diameter and predetermined depth from the ground level 3. As shown, the strand anchor includes strand 4 comprising a plurality of pre-stretched, pre-twisted galvanized wires 5. A galvanized open rope socket 6 or other end fitting device is fitted onto the upper end of the strand and is adapted to connect with a guy cable, not shown.

The strand 4 has a plurality of centering means 8 which are longitudinally spaced along the strand 4 so as to engage and surround the strand. As explained later, the centering means 8 serves to center the strand 4 into the drilled hole 2 prior to insertion of grout into the hole.

A galvanized pipe 9 acting as a casing may surround the upper part of the strand and as shown extends above the ground level 3. The casing prevents grout breakage adjacent to the ground level and thus preserves the integrity of the anchor device against corrosion. The casing preferably is of slightly greater outside diameter than the diameter of the drilled anchor hole 2 and has an inside diameter which is substantially equal to the diameter of the drilled anchor hole 2. Grout 10 inserted into the hole intimately contacts the strand 4, the centering means 8 and the sides of the drilled hole 2 whereby tension forces in the strand 4 may be transferred by shear forces in the grout to the sides of the drilled hole.

Figure 3:
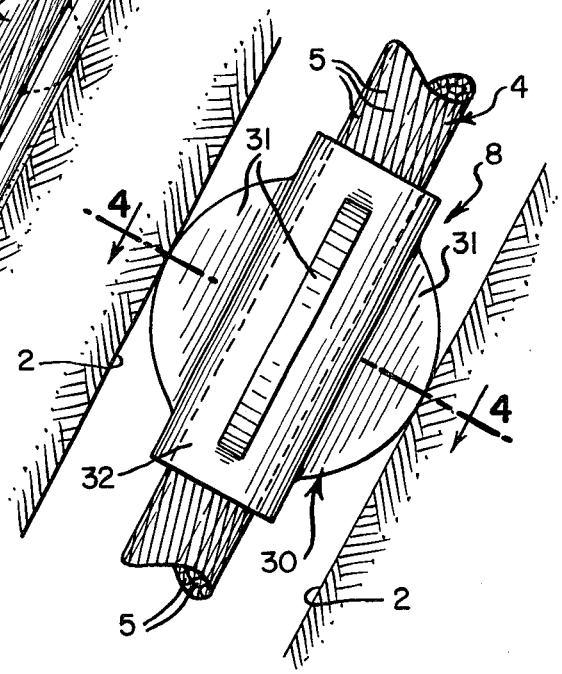
FIG. 3 is an enlarged view of a portion of FIG. 1 illustrating centering means for centering a strand in a drilled anchor hole.
Figure 4:
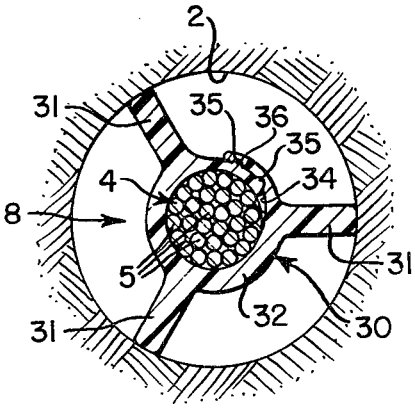
FIG. 4 is a cross-sectional view of FIG. 3 taken along lines 4—4.

Referring to FIGS. 3 and 4 a form of centering means 8 is illustrated and comprises a plastic spacer 30 having thereon three rounded legs or wings 31 which are integral with a sleeve portion 32. As shown in FIG. 3, the legs or wings 31 center the strand in the hole 2. The legs or wings 31 preferably are curved or rounded on their outer portions in order that they may slide over slight imperfections in the sides of the drilled hole when the strand is inserted into the hole.

As shown in FIG. 4, the sleeve portion 32 is preferably cut at 34 in order that the sleeve may be spread apart such that it may be slipped over a strand. Detents 35 on one part of the sleeve engage notches 36 on another part of the sleeve and serve to lock the sleeve in a closed position to firmly engage the strand so that it will remain fixed on the strand when the strand is inserted into the pre-drilled hole.

Figure 2:
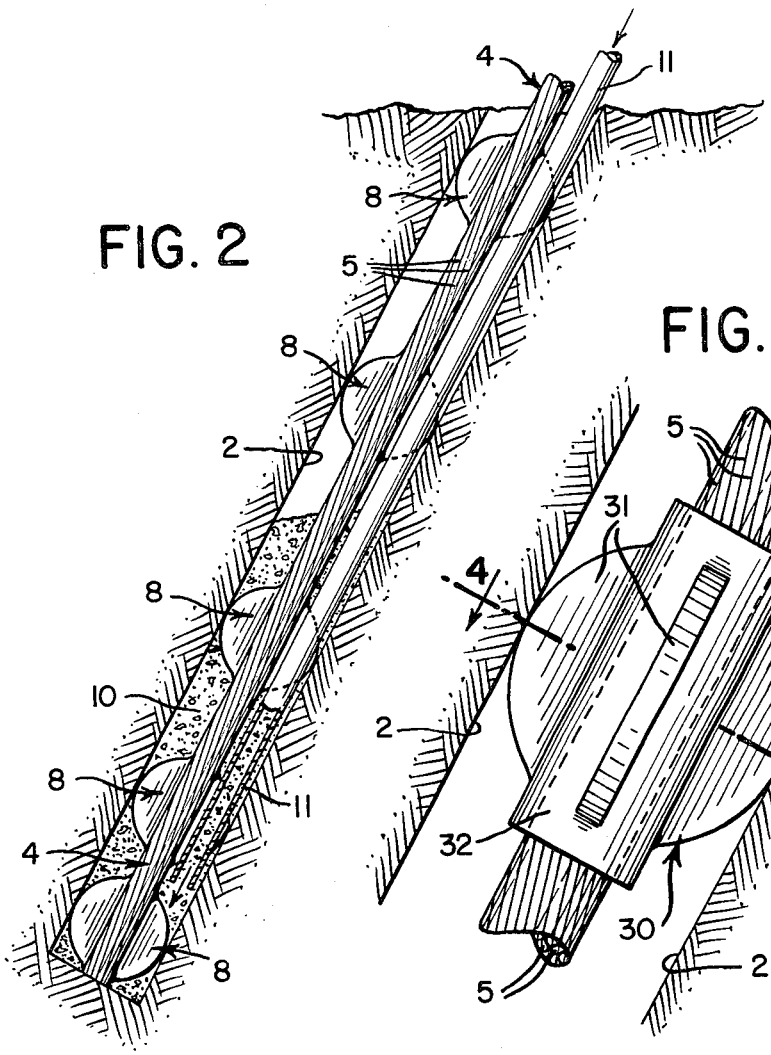
FIG. 2 is a view of a bottom portion of the anchor of FIG. 1 during the step of injecting grout into the drilled anchor hole.

Referring to FIG. 2 it is seen that the grout 10 is pumped into the anchor hole 2 through a grout hose 11 which extends substantially to the bottom of the hole. After the level of the grout rises in the hole substantially to ground level, the hose is then removed from the hole while at the same time, grout is continued to be pumped through the hose. In this manner, the bottom of the grout hose never extends above the grout level during insertion of the grout in the hole thus assuring that no voids will result.

In assembling the strand anchor, a casing hole is initially drilled into the ground to a depth of approximately four feet and the casing pipe 9 inserted therein so that its upper end extends approximately one foot above the ground level. The anchor hole 2 is then drilled into the ground by a drill extending through the casing pipe with the depth of the hole 2 being determined by the soil conditions encountered and tension loads to be accommodated. In practice we have found that the diameter of the hole 2 should be approximately four inches and the drilled depth of the hole should be forty-five to sixty feet in shales to accommodate tension loads on the order of 140,000 and 195,000 pounds respectively.

Centering means 8 are then applied to a length of the strand 4 and are positioned approximately five feet apart. The grout hose preferably is connected to the strand 4 so as to extend along its length. The strand, the centering means and the grout hose are then inserted as a unit into the hole 2 until the end of the strand is substantially at the depth of the drilled hole. Grout is then pumped through the grout hose until the level of the grout rises to substantially ground level. The grout hose is then pulled from the hole while continuing to pump grout through the hose.

Care should be taken during insertion of the strand into the drilled hole 2 to make sure that the strand remains clean and no dirt contacts it. This is to insure that there will be intimate locking contact of the grout with the outer periphery of the strand.

The strand itself may comprise a bridge strand on the order of 1.38 inches in diameter for accommodating tension loads on the order of 195,000 pounds or may comprise a wire rope. Such strand is sufficiently pliable so that it may be rolled from a reel and handled without use of special machinery which is important where the anchorage areas are in hilly and mountainous terrain.

The comparatively small diameter of the drilled hole results in that comparatively light portable drilling equipment may be used which can easily be transported to the anchorage areas. The strand may be cut to the desired length either at the area or at a shop site and the plastic centering means may be applied at the anchor site.

As the strand is flexible, it may be conveniently transported to the anchorage area and then inserted into the pre-drilled hole even if the drilled anchor hole is curved. The centering means will insure centering of the strand in the hole which is important so that the grout will provide the necessary transfer of the tension forces in the strand by shear forces to the sides of the anchor hole. If the strand were to contact the sides of the hole, there would be reduced transfer of forces at the point of contact.

We claim:

1. A grounted strand anchor for transferring tension load to the ground comprising an anchor hole drilled into the ground to a predetermined depth and a predetermined diameter, a predetermined length of strand having a plurality of pre-stretched, pre-twisted wires, a plurality of longitudinally spaced centering means engaging and surrounding said strand adapted to center said strand in said anchor hole, and grout surrounding and engaging said strand along its complete length in the hole, engaging said centering means and engaging the sides of the anchor hole whereby tension loads in said strand are transferred by shear forces in said grout to the sides of said hole.

2. A grouted strand anchor according to claim 1 wherein said wires are galvanized.

3. A grouted strand anchor according to claim 1 having in addition a protective sheath surrounding a portion of the length of said strand and grout in an area adjacent the ground level to minimize grout breakage and corrosion of the wires of said strand adjacent the ground level.

4. A grouted strand anchor according to claim 3 wherein the depth of the anchor hole is less than said predetermined length of said strand whereby a portion of said strand will extend above the ground level.

5. A grouted strand anchor according to claim 4 wherein a portion of said protective sheath extends above the ground level.

6. A grouted strand anchor according to claim 3 wherein said protective sheath comprises a galvanized steel pipe.

7. A method of making a grouted strand anchor for transferring tension load to the ground comprising the steps of drilling an anchor hole in the ground to a predetermined depth and diameter, applying a plurality of centering means to a length of a strand having a plurality of pre-twisted, pre-stretched wires, inserting said strand and centering means into the anchor hole such that the strand is centered in the anchor hole and until the end of said strand extends substantially to the bottom of the anchor hole, pumping grout into the anchor hole to fill the anchor hole substantially to ground level whereby the grout will intimately contact the outer wires of the strand and along its complete length in the hole and contact the centering means, and allowing the grout to set.

8. A method of making a grouted strand anchor according to claim 7 including the additional steps of removably attaching a grout hose along the length of the strand prior to inserting the strand in the anchor hole such that an end of the hose is substantially adjacent the bottom of the anchor hole and removing said hose from the anchor hole after the level of grout pumped into the anchor hole has risen substantially to ground level while simultaneously continuing to pump grout through the hose.

9. A method of making a grouted strand anchor according to claim 7 including the additional steps of drilling a casing hole of slightly greater diameter than the anchor hole and of a depth less than the predetermined depth of the anchor hole prior to drilling the anchor hole and of inserting a length of a galvanized pipe into the casing hole.

* * * * *

UNITED STATES PATENT AND TRADEMARK OFFICE

CERTIFICATE OF CORRECTION

PATENT NO. : 4,360,292

DATED : November 23, 1982

INVENTOR(S) : Andrew L. Keeler and Ronald Marsico

It is certified that error appears in the above-identified patent and that said Letters Patent is hereby corrected as shown below:

Col. 2, line 9, change "projected" to --protected--

Signed and Sealed this

*Fifteenth* Day of *March 1983*

[SEAL]

*Attest:*

GERALD J. MOSSINGHOFF

*Attesting Officer*

*Commissioner of Patents and Trademarks*